US005555731A

United States Patent [19]

Rosenblatt

[11] Patent Number: 5,555,731

[45] Date of Patent: Sep. 17, 1996

[54] PREHEATED INJECTION TURBINE SYSTEM

[76] Inventor: Joel H. Rosenblatt, P.O. Box 198, Summerland Key, Fla. 33042

[21] Appl. No.: 395,437

[22] Filed: Feb. 28, 1995

[51] Int. Cl.[6] ..... F01K 25/00

[52] U.S. Cl. ..... 60/671; 60/651; 60/677

[58] Field of Search ..... 60/671, 651, 677

[56] References Cited

U.S. PATENT DOCUMENTS

| | | | |
|---|---|---|---|
| 2,924,074 | 2/1960 | Chambadal et al. | 60/677 |
| 3,029,197 | 4/1962 | Untermyer | 60/677 |
| 3,040,528 | 6/1962 | Tabor et al. | 60/36 |
| 3,234,734 | 2/1966 | Buss et al. | 60/651 |
| 3,511,049 | 5/1970 | Norton et al. | 60/36 |
| 3,750,393 | 8/1973 | Minto et al. | 60/36 |
| 3,857,245 | 12/1974 | Jones | 60/651 |
| 4,063,420 | 12/1977 | Sloyan | 60/671 |
| 4,109,469 | 8/1978 | Carson | 60/676 |
| 4,242,870 | 1/1981 | Searingen et al. | 60/651 |
| 4,262,485 | 4/1981 | Kuroda et al. | 60/669 |
| 4,463,567 | 8/1984 | Amend et al. | 60/671 |
| 4,503,682 | 3/1985 | Rosenblatt | 60/651 |
| 4,526,006 | 7/1985 | Anthony | 60/671 |
| 4,604,867 | 8/1986 | Kalina | 60/653 |
| 5,421,157 | 6/1995 | Rosenblatt | 60/651 |

*Primary Examiner*—Denise L. Gromada

*Assistant Examiner*—Alfred Basichas

*Attorney, Agent, or Firm*—Jacobson, Price, Holman & Stern, PLLC

[57] ABSTRACT

A power turbine system operating in an organic Rankine cycle with a thermodynamic medium flowing therethrough, including a power turbine (10) having an inlet connected to a conduit (50) and an exhaust (14), a lower temperature engine system having a heat engine, a circulating thermodynamic turbine medium flowing through the heat engine and producing rejected waste heat during engine system operation, a regenerative heat transfer device (6) for heating the turbine medium from the turbine exhaust (14) to produce liquid phase turbine medium at an elevated temperature, a pump (28) for pumping the liquid phase turbine medium at the elevated temperature as a first boiler feed return stream, a boiler feed return stream conduit (50) for conducting the boiler feed return stream to the turbine (10) through branch conduits (51, 52) and injectors (53, 54) and to pump (55) to boiler vessel (56) for heating the turbine medium to be fed to the turbine inlet. The injectors (53, 54) are positioned along the turbine cycle between successive stages and are controlled by controlling the mass flow of the injected liquid phase turbine medium therethrough into the turbine (10) for effecting a selected vapor quality of the resulting mixture. The turbine medium is a thermodynamic medium such as isopentane having a tendancy to diverge toward the superheated region from the saturation curve thereof during isentropic expansion of the vapor thereof across the pressure gradient traversed by the turbine cycle.

20 Claims, 3 Drawing Sheets

PREHEATED INJECTION TURBINE SYSTEM

This invention relates to an improvement in the LOW TEMPERATURE ENGINE SYSTEM (referred to hereinafter as LTES), as described in U.S. Pat. No. 4,503,682, incorporated herein by reference.

BACKGROUND OF THE INVENTION

As thermodynamic media expand isentropically through a power turbine in a Rankine cycle system, the vapor quality varies for any vapor whose saturation curve across the pressure range traversed during that expansion is not parallel with the isentropic value along which the expansion occurs. When steam is the medium being expanded, this results in the vapor proceeding from a possible superheated region at high temperature and pressure, through the saturation range, and finally may enter a "wet" vapor condition as exhaust pressure is reached. It has become common practice to employ a "reheat" cycle to overcome difficulties resulting from this steam characteristic. The steam, after partial expansion along the turbine cycle, is extracted and returned to the boiler for reheating up to a new superheated condition for its now reduced pressure, and then returned to the turbine to continue further expansion. Excessive moisture in the steam ( i.e.—generally a vapor quality less than perhaps 88%) can cause loss of efficiency in the turbine and can cause blade damage and pitting due to moisture particle impact of the back sides of the blading.

Recent interest in use of hydrocarbon and fluorocarbon media in low-temperature turbine cycles (commonly known as Organic Rankine Cycles) has introduced use of media which frequently behave characteristically in a manner opposite to that of steam during expansion. Many of these turbine media expand isentropically along a curve of reverse slope to that of their saturation curves. As a result, such media may start at the beginning of their expansion in a wet or saturated condition, become progressively drier or superheated during expansion as they diverge from the saturation curve, and frequently arrive at final exhaust pressure in a superheated condition. Under these conditions, the superheat content of the vapor at exhaust may be lost as additional waste heat, substantially hotter than saturation temperature for the exhaust pressure, leaving both the superheat and the latent heat to be removed by condenser cooling water to effect condensation.

It has also been common steam turbine practice to provide means for extracting a portion of the expanding steam at various locations along the expansion process and to use the extracted steam to heat the returning feed water stream. This is known as the "regenerative" Rankine cycle. In the process, a portion of the heat content of the extracted steam is retained within the circulating turbine cycle that would otherwise have been lost as waste heat in the condenser. That heat energy loss prevention contributes increased thermodynamic efficiency to the total turbine cycle. However, the mass flow of the amount of steam extracted for this purpose becomes an amount that was never expanded all the way to the exhaust conditions, and therefore does not contribute all the output power that might have been available had it been expanded all the way to condenser pressure.

Also from the prior art is known an analogous technique for recovery of some exhaust superheat condition in the cycle of one of the reverse-slope media turbine cycles and cooling it via heat exchanger means with the boiler return feed stream before completing the condensation function closer to saturation temperature for the exhaust pressure. It thereby recovers much of what would have been waste superheat loss in the condenser by regenerative feed stream heating. This cycle is known as a "recuperative" cycle.

It is also known to take advantage of the characteristic reverse slope of the turbine media that dry on expansion (viz.—butane, isobutane, iso-pentane, and several of the fluorocarbons) by provision of one or more injectors located along the expansion route of the medium through the turbine at which it may become desirable to reduce developing superheat or drying out of the expanding turbine medium, by injecting a controlled amount of liquid phase turbine medium into the vapor stream passing through the turbine at that point. The mixture of the liquid injected with the vapor in transit creates a new thermodynamic state condition in the flowing fluid, desuperheated or wetter than the superheated condition it had reached just before the point of injection. Depending on the proportions of the mass flow of liquid injected to the mass flow of the vapor into which it is injected, the ensuing vapor quality of the mixture can be controlled to whatever level is preferred so that ensuing further expansion will result in arriving at final exhaust conditions with a lower superheat content for the pressure at which ultimate condensation of the exhaust is intended to occur. If the pressure range across which isentropic expansion occurs is great enough, or the slope is great enough to cause more rapid drying during expansion, two or more injection points along the expansion process may be desired to control moisture content of expanding vapor within preferred limits.

Final power output of the turbine is also related to the mass flow of turbine medium undergoing expansion through the turbine. As additional medium is injected to absorb evolving superheat, mass flow is also increased for the on-going expansion process beyond the point of injection, contributing an additional increment of output power to the turbine cycle. The higher the temperature at which injected medium is introduced to the turbine, the greater mass flow can be injected to effect desuperheating of the expanding medium and thereby further increase ensuing mass flow being expanded in remaining portions of the turbine cycle below the point of injection. U.S. Pat. No. 3,234,734 to Buss, et al. incorporated herein by reference teaches this concept. In a regenerative Rankine cycle, quantities of turbine medium in the feed stream return were progressively heated by medium extraction points along the turbine cycle which provided sources of liquid turbine medium at progressively higher temperatures along the feed stream return path. These sources were used to supply injection liquid phase medium to desuperheat the vapor flow at selected injection points along the turbine expansion cycle. In that teaching, the heat source elevating the feed stream temperature, by regenerative extraction of vapor from the turbine, originated from heat energy already within the expanding turbine medium within the turbine. That encumbered a loss of turbine mass flow to supply the vapor extraction (a characteristic of all regenerative Rankine cycles).

In U.S. Pat. No. 3,234,734, to J. R. Buss et al., preheating was accomplished by extraction of hot vapor from the turbine itself (as practiced in conventional regenerative turbine cycles), but in that process, heat energy content of the medium mass flow through the turbine was reduced and then replaced, to effect the benefits realized in superheat waste reduction.

BRIEF SUMMARY OF THE INVENTION

While prior art has suggested that any number of external sources of auxiliary low grade heat might be used for feed stream heating, the Low-temperature Engine System (U.S. Pat. 4,503,682) contains, within its own total engine system equipment complement, the source of regenerative heat energy employed to preheat the turbine medium-return stream. It is delivered in the form of heat transferred from the refrigerant vapor condensation processes in the LTES refrigeration sub-system.

The principle object of this invention is to provide a power turbine system employing turbine injectors to supply additional liquid phase turbine medium to the turbine at the elevated temperature acquired after that liquid medium has performed its function in the LTES of absorbing waste heat from the refrigeration subsystem of the LTES. Returning liquid phase turbine medium thereby accomplishes both the waste heat recovery function from the absorption refrigeration subsystem of the LTES, and retains a beneficial use for a portion of the mass flow used for that purpose within total turbine medium flow without requiring it to be further heated by the external heat source supplying the turbine medium boiler prior to medium vapor entry in the turbine cycle.

A further object of this invention is to provide a power turbine system with more beneficial use of regenerative heat acquired from the refrigeration sub-system of the LTES by its becoming part of the energy converted to useful output power during subsequent expansion through remaining stage(s) of the conventional above ambient ORC turbine. In the basic LTES cycle, condensed ORC feed stream heating is accomplished at two points of heat exchange between the ORC turbine medium condensate and the absorption refrigeration (AR) sub-system. Most of the waste heat rejected from the AR sub-system comes from the ammonia condenser of that AR system at a temperature slightly above saturation for the pressure in the ammonia stream. A second quantity of regenerative heat recovery occurs, immediately after cooling the ammonia condenser, by its passage in heat exchange relationship through the rectifier section of the AR system, where it absorbs both ammonia vapor superheat and latent heat of the water vapor partial pressure present in the vapor boiled off in the generator of the AR sub-system. That results in producing a turbine medium condensate return stream at substantially higher than ambient induced temperature in the condenser wet-well. FIG. 3 illustrates the circulation path details through affected components in an enlarged scale.

From the above description, preheated turbine medium is available in LTES embodiments from the regenerative heat energy received from both the ammonia condenser and the rectifier stage of the AR subsystem. Those parameters may be manipulated to result in whatever temperatures may be desired limited by the requirement that cooling of the vapor in the rectifier must proceed far enough to assure complete condensation of the partial pressure of water vapor present in the refrigerant vapor in the rectifier. Other than that, the outlet temperatures of the turbine liquid phase medium from the ammonia condenser and the rectifier may be chosen across the range thereby defined to produce the desired extraction temperature of medium to be injected into the conventional ORC turbine cycle to effect desuperheating of medium circulating through that turbine, together with maximizing output power delivered.

Another object of the invention is to recover waste superheat loss potential by injecting preheated medium into an ORC turbine cycle at points where the resulting mixture can absorb superheat from the vapor with which injected preheated medium was mixed to produce thermodynamic state conditions in the resulting mixture which will result in reduced waste superheat losses when the mixture is subsequently discharged to the turbine condenser after having completed its expansion process. The procedure retains the advantage of use of turbine injectors described in the prior art, accomplishes the benefit intended by the recuperative cycle described in the prior art without losing superheat content remaining in the approach difference required between turbine exhaust vapor and its subsequent condensate temperature to effect that recouperative waste heat recovery, and adds an additional source of external heat energy to the total mass flow of turbine medium expanding through the turbine other than that supplied by its boiler.

This proposed new elevated temperature injection cycle not only converts what might have become additional waste superheat content in the turbine exhaust to levels closer to saturation conditions when exhaust pressure has been reached, but also absorbs that heat at pressure levels above exhaust conditions, creating additional total turbine medium mass flow for the remaining turbine cycle. This results in the opposite effect from that described above related to extraction of turbine medium above the exhaust condition. Instead of removing and replacing heat energy in the mass flow ultimately reaching turbine exhaust, the medium injected contains an increase in turbine medium heat energy content contributing output power to the total turbine expansion cycle with no offsetting heat energy loss to the mass flow traversing the turbine cycle by extraction of a portion of its mass flow.

BRIEF DESCRIPTION OF THE DRAWINGS

The invention will now be described in detail with reference to the accompanying drawings wherein.

DETAILED DESCRIPTION OF THE INVENTION

Figure 1:
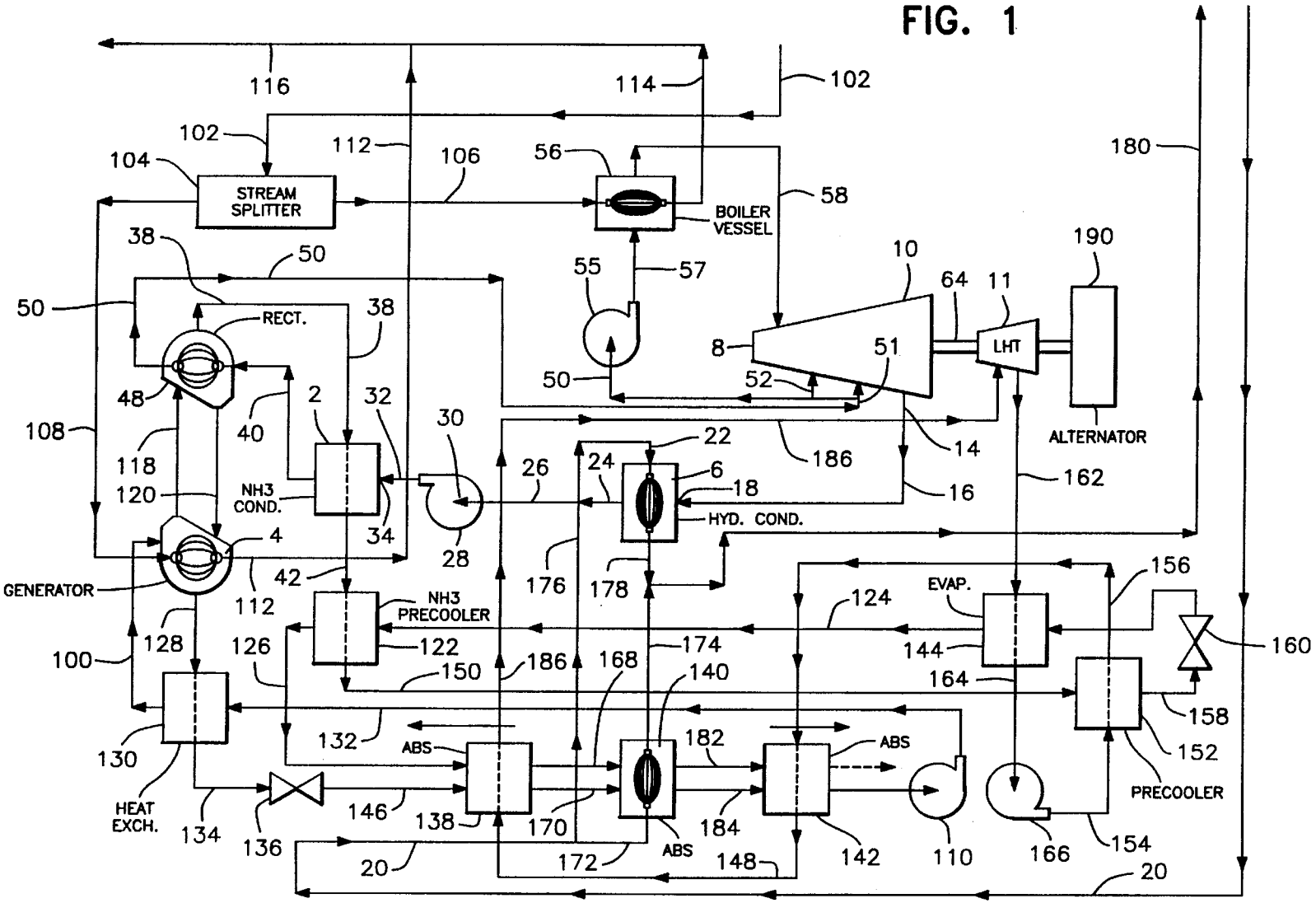
FIG. 1 is a system diagram of an embodiment of a low temperature engine system incorporating the present invention.

Some components in FIG. 1 are components of the absorption refrigeration (AR) sub-system as described in the referenced U.S. Pat. No. 4,503,682, and perform the same refrigeration sub-system functions as in the patent.

Within that AR sub-system, a concentrated solution of refrigerant (e.g., ammonia) in its absorbent (e.g., water) enters the generator 4 via conduit 100. It is heated therein by a stream of steam from an external source such as exhaust from a high pressure steam turbine (not shown) associated with the system. That steam enters the system via conduit 102 and through a stream splitter 104, a portion being split off to supply external heat to a conventional hydrocarbon turbine cycle boiler vessel 56 via conduit 106, while the remainder becomes the external heat source supplying steam via conduit 108 to generator 4, under conditions that raise the temperature at the elevated pressure in generator 4 created by circulating pump 110. The steam condensate return from generator 4 via conduit 112 and from boiler 56 via conduit 114, is returned to the steam condensate return of the system that delivered the external heat via unit 116, which could be a feed water heater stage in the feed water return system of an associated high pressure steam turbine whose exhaust supplied the external heat source via conduit 102 to the entire low temperature engine system.

A high temperature vapor at elevated pressure flows from generator 4 via conduit 118 to rectifier vessel 48. While the operating temperature of generator 4 has been selected to result in maximum vaporization of the ammonia portion of the strong solution entering it, a minor fraction of partial pressure of water accompanies the vapor stream delivered. As that vapor is partially cooled in rectifier vessel 48, that partial pressure water vapor fraction condenses before the ammonia vapor fraction. The liquid condensate thereby formed is trapped out and returned to generator 4 via conduit 120. The ammonia vapor fraction, still at elevated temperature and pressure leaves vessel 48 via conduit 38 to enter the ammonia condenser vessel 2 where it is condensed by flow in heat exchange relationship with condensed counterflowing liquid phase UHT turbine medium entering at 34 via conduit 32, and exiting via conduit 40 after having absorbed both the superheat and latent heat rejected from the ammonia vapor during its condensation in vessel 2. The condensed liquid phase ammonia then flows via conduit 42 to an ammonia pre-cooler 122 wherein it passes in heat exchange relationship with counterflowing ammonia vapor entering via conduit 124 and leaving, slightly warmer, via conduit 126.

The weakened refrigerant/absorbent solution remaining in generator 4 after the vapor was boiled off returns via stream 128, still at elevated temperature and pressure, through a heat exchanger 130 placed between the flows of high temperature weak solution from generator 4 and cooler low-temperature strong solution entering via stream 132. This permits strong solution being directed to generator 4 to be preheated prior to entry therein, while weak solution from generator 4 is pre-cooled prior to entry via conduit 134 into pressure-reducing valve 136, where that weak solution is dropped to the operating pressure of the absorber 138,140, 142, the same reduced pressure at which the refrigeration sub-system evaporator 144 is operating. Strong cool weak solution then leaves valve 136 at reduced pressure via conduit 146 to combine with ammonia vapor from pre-cooler 122 via conduit 126 in the warm end of absorber 138, both streams now being at the same reduced pressure. As the two streams mix, both a heat of solution (heat of mixing) and latent heat from condensing ammonia vapor are rejected in heat exchange relationship with a stream of condensed LHT turbine 11 medium supplied to absorber 138 via conduit 148. In that heat exchange process, a portion of the ammonia vapor enters into solution in the weak solution with which it is being mixed, and is partially cooled, while the counterflowing LHT turbine medium is heated to the vapor phase turbine entry state conditions at the entry to the LHT turbine 11.

Liquid phase ammonia refrigerant, still at elevated pressure, which was condensed in condenser 2 and pre-cooled in unit 122, proceeds from unit 122 via conduit 150 to a second ammonia pre-cooler 152. There it is further pre-cooled by being placed in heat exchange relationship with counterflowing cold LHT turbine medium entering via conduit 154 and leaving via conduit 156. Having been further pre-cooled by this process, the high pressure liquid ammonia leaves pre-cooler 152 via conduit 158 to enter pressure reducing valve 160 where its pressure is dropped to the low pressure at which the evaporator and absorber units are operating. That sudden drop in pressure, below saturation pressure for the refrigeration temperature intended to be created in evaporator 144, causes the refrigerant to flash to a vapor phase, absorbing its latent heat of vaporization from the counterflowing vapor phase LHT turbine 11 medium in heat exchange relationship with the refrigerant flowing through evaporator 144.

The LHT turbine 11 medium entering evaporator 144 via conduit 162 in its vapor phase is condensed therein to its liquid phase by that refrigerating effect, and leaves in its liquid phase via conduit 164. The cold liquid turbine medium is then pressurized to its intended turbine entry operating pressure by pump 166 from whence it leaves via conduit 154 to enter pre-cooler 152 as described above. The two phase mixture of ammonia vapor and ammonia/water solution formed in absorber 138 as described above leaves absorber 138 via conduits 168 and 170 and enters absorber stage 140 where the two phases continue being mixed while being further cooled by external ambient cooling water supplied to the system via conduit 20, a portion of which supplies cooling to absorber 140 via conduit 172, by passing in heat exchange relationship within unit 140 and leaving slightly warmer via conduit 174, while the remainder continues as a stream via conduit 176 to become coolant for ambient hydrocarbon condenser vessel 6.

The cooling water leaving absorber 140 via conduit 174 and that leaving condenser 6 via conduit 178 combine to become the cooling water return leaving the system via conduit 180.

As the mixture of ammonia vapor and ammonia/water solution is further cooled in absorber 140, more of the ammonia vapor enters solution rejecting waste heat as it does to counterflowing cooling water. The remaining mixture flows via conduits 182 and 184 to the final stage of the absorber, unit 142. It is finally cooled there to the temperature at which all the remaining ammonia vapor will dissolve in the solution with which it is being mixed to reform the strong ammonia/water solution at its maximum intended solution concentration in the system. That final cooling is accomplished by passing cold LHT turbine medium from unit 152 via conduit 156 in heat exchange relationship with the contents of unit 142 to absorb that last waste heat fraction that must be rejected to effect complete absorption of all ammonia vapor in forming the strong ammonia/water solution. The cold LHT turbine medium leaves unit 142 via conduit 148.

The below ambient turbine system shown in the drawing associated with the sub-ambient turbine 11 is similarly not altered by the present improvement. The LHT turbine 11 driving the alternator 190 to deliver electric power from the system employs a second hydrocarbon medium which circulates from the turbine exhaust leaving turbine 11 via conduit 162 to the AR subsystem evaporator 144 where it is condensed at a sub-ambient temperature by refrigeration developed by the AR subsystem, the cold condensate leaving via conduit 164 to enter pump 166 where it is pressurized to the peak pressure in the LHT turbine cycle, leaving the pump via conduit 154 to become a coolant to pre-cool ammonia refrigerant in pre-cooler 152, leaving unit 152 via conduit 156 to be used again to cool the bottom end of the AR sub-system absorber in unit 142 and finally leaving via conduit 148 having attained its turbine entry vapor phase temperature by absorbing additional waste heat at a higher temperature in AR sub-system absorber 138 from which it leaves via conduit 186 to return to the turbine entry point of the LHT turbine.

While both the refrigeration sub-system described and the operation of the LHT turbine cycle remain as described in the above referenced patent, a significant thermodynamic improvement is effected by the turbine cycle of turbine 10 of this invention.

The condenser of the AR subsystem refrigerant is shown at 2. Latent heat from the refrigerant in condensor 2 is rejected at the saturation pressure of the refrigerant circulating through it, at the operating pressure of the AR subsystem generator 4. The higher that operating pressure may become, the higher the saturation temperature at which the latent heat rejected to condense the refrigerant will occur.

The ambient hydrocarbon condenser 6 is connected in the upper hydrocarbon turbine cycle which proceeds through hydrocarbon turbine 10. This turbine unit embodiment shown in the diagram is only a single turbine system with an extraction or exhaust point 14.

The hydrocarbon turbine medium at its exhaust pressure at outlet 14 of turbine unit 10 is conducted through conduit 16 to condenser inlet 18 where it is condensed conventionally at a minimum approach temperature above that of the ambient cooling source, such as water, for example, supplied to condenser 6 through conduits 20 and 176 and inlet 22 and the turbine medium condensate leaves condenser 6 through outlet 24 via conduit 26. The condensate return pump 28, having inlet 30 connected to conduit 26 pressurizes the returning feed stream to an elevated pressure in pump outlet conduit 32, still at approximately the temperature at which it was condensed in condenser 6. The hydrocarbon turbine medium is then supplied as a cooling stream to inlet 34 of the refrigerant condenser 2 of the AR subsystem, where it receives at least the latent heat rejected from the refrigerant flowing therethrough from conduit 38 to effect condensation of the liberated refrigerant vapor leaving the rectifier vessel 48 of the AR subsystem. At that point, the temperature of the liquid turbine medium return stream is now at the elevated temperature induced by regenerative absorption of at least the latent heat rejected from the condensing refrigerant vapor. The hydrocarbon turbine medium exiting condenser 2 via conduit 40 may also have acquired some refrigerant vapor superheat before condensation begins, and some amount of heat from sub-cooling of the refrigerant condensate leaving condenser 2 through conduit 42.

At this elevated temperature the hydrocarbon turbine medium in conduit 40 flows to rectifier 48 and out therefrom via conduit 50 to injection points 53 and 54 in turbine 10.

The return feed stream in conduit 46 may now continue its cycle, being heated successively by absorption of the superheat content of the refrigerant vapor leaving unit 48 in conduit 50 and flowing through pump 52 and conduit 54, and finally being heated to turbine entry conditions of turbine unit 10 in heat exchanger unit 56, the hydrocarbon boiler, from where it is conducted by conduit 58 to the inlet of turbine unit 10.

In the present invention, injected liquid medium adds external heat energy to the total already contained in the turbine cycle mass flow, at no reduction of mass flow of total flow in circulation through the turbine from its entry. In the total combined cycle LTES equipment complement, even the reduced residual superheat in the third example presented could be recovered regeneratively by passing the conventional ORC turbine medium through a heat exchanger located between the turbine exhaust and condenser. Instead of the ordinarily doubled approach losses encumbered when such a heat exchanger is employed as a "recouperator" (with its ownwet-well condensate flowing on the cold side), the medium flowing in the sub-ambient turbine of the LTES can acquire that remaining superheat with only a single approach difference loss, and, in the process, raise the turbine entry temperature of the sub-ambient turbine to further increase the power contribution to the total system output delivered by the sub-ambient turbine cycle (LHT 11 in FIG. 1).

The material presented illustrates that variations in injector locations and injected masses control both the amount and temperature of residual waste superheat left in the cycle at turbine exhaust conditions. By coordinating that quantity with the planning of the sub-ambient turbine cycle in LTES, their manipulation can effect optimization of both the conventional above-ambient turbine cycle and the LTES sub-ambient turbine cycle to maximize net power output of their combination in an LTES application.

In the examples presented, companion trial cycles were evaluated in which the mixture created by the injectors was carried into the wet vapor region in an effort to further increase the mass flow injected and further reduce residual superheat at turbine exhaust. The net effect resulted in less total power output for the trial cycles examined for the above-ambient turbine cycle standing alone. However, the effect of increasing injection amounts on the associated sub-ambient turbine 11 in the LTES equipment complement may offset minor losses in this turbine as described below.

The greater the mass flow of liquid medium that can be injected to mix with the mass flow of expanding vapor receiving the injected liquid, the greater the mass flow of the ensuing fluid will become for further expansion in the ensuing portion of the turbine system. The limitation of how much fluid may be injected is the thermodynamic state properties of the mixture effected, which must ideally remain in not much less than a saturated condition for the resulting pressure and temperature conditions of the mixture, and at not less than a minimum vapor quality to avoid damage to the blading of the ensuing turbine stage(s). The heat energy available in the mixture for establishing those conditions comes from the enthalpy contained in the superheat of the mass flow of the expanding vapor that exceeds the saturation unit enthalpy of the mixture formed. That superheat must equal the specific heat enthalpy needed to raise the temperature of the liquid phase medium injected to saturation temperature of the mixture, plus the latent heat required to bring the injected portion of the mixture up to the minimum vapor quality required for further expansion in ensuing turbine components.

The hotter the liquid fraction being injected (a temperature as close to or equal to the saturation temperature intended for the ensuing mixture), the less vapor superheat available must be consumed to heat the liquid phase of the injected medium, and the more becomes available to supply latent heat required to achieve desired vapor quality of ensuing mass flow of the mixture. In the LTES equipment complement, heat energy supplied to preheat the injected mass flow comes from associated LTES equipment components, whose parameters may also be manipulated to alter the amount and temperature of heat rejected to preheat liquid phase turbine medium employed to supply injectors. Such total system parameter manipulations may be optimized by the designer to fit a solution to the specific application being considered.

In the LTES cycle, the ratio of mass flow of turbine medium circulating through that portion of the turbine cycle expanding down to the coldest available ambient condenser, to mass flow of the portion expanded from ambient to the sub-ambient sink temperature synthesized by the refrigeration sub-system, is directly related to the entire efficiency increase and power output gain offered by the LTES system.

The minimum mass flow able to absorb that regenerative heat energy quantity from the refrigeration sub-system determines that ratio.

After absorbing the required amount of regenerative heat transfer available, a portion of that mass flow may be withdrawn at its now elevated temperature via conduit 50 and branch conduit 51, or branch conduits 51 and 52. Control valve 61, or valves 61 and 62, may be used to control flow to the injectors(s). The liquid medium is then injected into the turbine through injector 53, or injectors 53 and 54, at the appropriate pressure or pressures, in the cycle at the selected injection point, or points. A larger injection mass flow can be accommodated than can be used at lower injection media temperatures characteristic of exhaust condensate in its non-preheated condition. Not only is waste superheat loss recovered as described in the above-referenced prior art, but the mass flow in the upper portion of the turbine cycle not used for supplying injectors but remaining to be heated by the external heat source supplying the total LTES system may be reduced. In the LTES cycle, that permits further reduction in the ratio of higher temperature turbine cycle mass flow (the above-ambient turbine 10 illustrated in the system diagram of FIG.1) remaining and conducted through pump 55 and via conduit 57 to boiler 56 to be heated by the external heat source 102 via conduct 106 supplying the system, to that in the sub-ambient turbine cycle mass flow 11 with a resulting increase in overall efficiency improvement made available by the LTES system. The heated turbine medium from boiler 56 flows via conduit 58 to the inlet of turbine 10. The turbine may be connected by a shaft 64 to an alternator 190 for example.

For such an application, the temperature at which the fluid being injected should be the highest temperature to which the turbine medium return stream may be heated by regenerative heat recovery from the refrigeration sub-system cycle of the LTES. By selecting a plurality of injection points at varying pressure locations along the turbine expansion path, the expansion can be directed to approximate whatever relationship to the saturation curve the designer may prefer. Injection points above that temperature might still be chosen advantageously, but a portion of the heat energy available in the mixture must be used to supply liquid phase specific heat before saturation conditions are reached and the mixture completely vaporized.

Means of supplying preheated liquid phase medium to the injection point or points may be accomplished by: use of metering pumps; use of a common pump supplying the medium from a common manifold via injectors adjusted to admit desired flow rates at desired pressures. This supplying of preheated liquid phase medium may also be made automatically adjustable to correspond with varying throttle flow rates at turbine entry under varying load conditions, and similarly rendered responsive to controlling moisture content along the turbine cycle. The equipment components required may be seen as analogous to means employed to supply diesel engine injectors.

Use of any additional heat recovery opportunity from an additional conveniently co-existing elevated temperature source, to further preheat the liquid medium prior to injection, is not precluded by use of the internal regenerative heat source available from the LTES AR sub-system as described. Examples of other potential sources constantly delivering above-ambient waste heat energy during operation of the power generation system, which are external to the circulating turbine medium itself, are: heat rejected from the alternator cooling system; in geothermal applications, residual heat energy content of the fluid medium supplying external heat energy source to the hydrocarbon boiler after it has performed its high temperature function of vaporizing turbine medium in the boiler (viz.—hot geothermal brine liquid or hot water fraction remaining after a reduced pressure flash process has been employed to remove a steam vapor fraction from the brine to supply a steam turbine); and even a stream such as that representing hot water condensate leaving generator 4 in the diagram of FIG. 1, which, after supplying heat to boil strong aqua solution in generator 4, will remain substantially above ambient for return.

Figure 2:
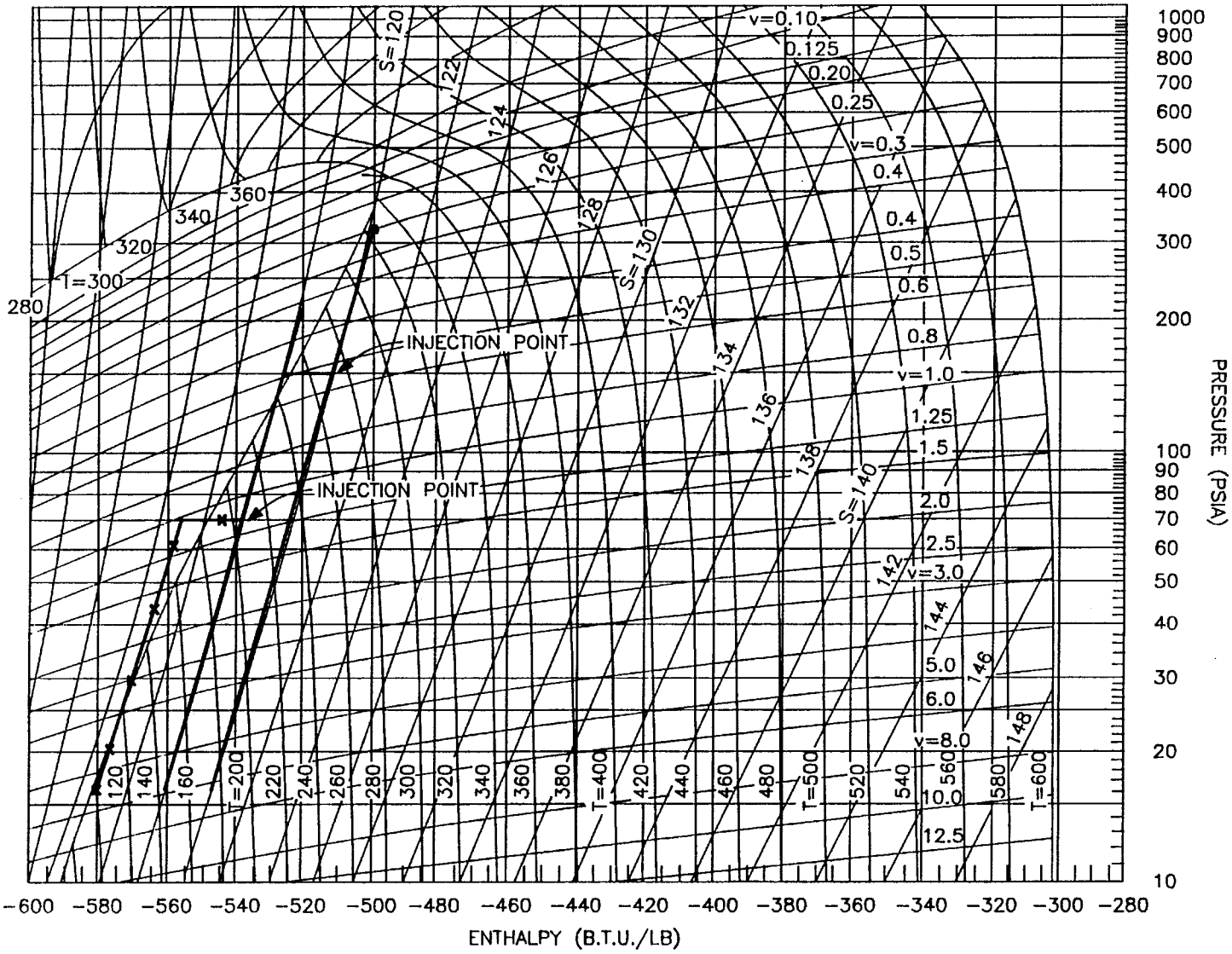
FIG. 2 is a diagram illustrating the thermodynamic state conditions occurring in the turbine cycle embodying the invention shown in FIG. 1 plotted on the dry vapor portion of a Moliere diagram for ISO-PENTANE.

FIG. 2. illustrates a portion of the saturation curve for isopentane, one of the media possessing the characteristic reversed slope of the saturation curve. The dashed line represents an isentropic expansion process for the medium expanding from an initial condition of a vapor at saturation at a pressure of 321.4 psia and a temperature of 320° F., to an exhaust condition at 17.04 psia, for which the saturation temperature will become 90° F. in the condenser. That line represents the theoretical isentropic turbine expansion path. It terminates at a temperature of 164° F., leaving a substantial superheat condition remaining at the turbine exhaust pressure, the saturation pressure for condensation to occur at 90° F.

The solid line represents the effect of introducing an injection point at 150 psia, with enough liquid phase medium along that isentropic path, to return the resulting mixture to the saturation curve at a temperature of 243.36° F. Thereafter, continued isentropic expansion to intended exhaust pressure of 17.1 psia causes exhaust to occur at a temperature of 140.95° F., still leaving fifty degrees F. of superheat to be removed by cooling water before condensation of the exhaust starts to occur.

Finally, the dashed lines with "x"'s on the diagram of FIG. 2. illustrate the cycle incorporating a second injection point located at a pressure of 75 psia. The resulting mixture brings the path back to the saturation curve at that pressure at a temperature of 185° F., and continued isentropic expansion from that point arrives at turbine exhaust pressure at a temperature of 112.52° F., with superheat at exhaust having been reduced over fifty degrees F. compared with the example containing no intermediate injection point. During the ensuing condensation process, waste heat to be rejected in the condenser has been decreased, and there has been a corresponding increase in turbine output power from each remaining expansion process beyond each successive point of injection to turbine exhaust pressure, due to successive increases of mass flow. These three examples are summarized in Table I., to present a quantified comparison of the thermodynamic improvements occurring as heated turbine medium is injected at the locations illustrated on the diagram of FIG. 2.

A similar effect could have been accomplished by injecting lesser quantities at a plurality of intermediate points along the expansion path to more closely approximate the saturation curve. The decision remains a matter of specific design application for a given turbine employing a given thermodynamic medium across a given thermal regimen between boiler outlet temperature and condenser temperature produced by best available ambient coolant supply.

Table I. also illustrates the magnitude of the power increase made available when the turbine is a component of a complete LTES system. The example chosen for this illustration was taken from a simulation of an LTES application. The complete equipment complement for that application is diagrammed in FIG. 1. While all the details of LTES equipment components shown may be superfluous to needs of this illustration, it facilitates recognition of Block ACN as the ammonia condenser of the AR subsystem, and Block RCT as the rectifier portion of the AR subsystem generator. In that LTES application, condensate return from the wet-well is used to collect regenerative waste heat rejected from the ammonia condenser and the rectifier of the AR subsystem of the LTES equipment complement. It thereby acquires a temperature of 170.87° F. before being employed as the liquid phase medium being injected. By virtue of that preheat, it contains 46.5 btu/lb more heat energy than condensate from the wet-well would have possessed, permitting approximately 30% greater mass flow to be injected at each injection point than a non-preheated supply would have allowed.

TABLE I

Injection Cycle Turbine State Condition Comparisons

| | Conventional ORC turbine | Single Injection | Second Injection |
|---|---|---|---|
| Turbine Entry Pressure | 321.4 psia | 321.4 psia | 321.4 psia |
| Turbine Entry Temperature | 320° F. | 320° F. | 320° F. |
| Mass Flow at Entry | 1.0 lb. | 1.0 lb. | 1.0 lb. |
| Pressure at First Injection | | 150 psia | 150 psia |
| Mass Flow Injected | | 0.082 lbs. | 0.082 lbs |
| Pressure at Second Injection | | | 75 psia |
| Mass Flow at Second Injection | | | 0.086 lbs |
| Exit Pressure | 17.04 psia | 17.04 psia | 17.04 psia |
| Exit Temperature | 164° F. | 140.95° | 112.52° F. |
| Exit Superheat | 32.47 btu | 13.17 btu | 8.92 btu |
| Mass Flow at Exit | 1.0 lbs. | 1.082 lbs. | 1.168 lbs. |
| Isentropic Output Work | 50.13 btu | 50.56 btu | 53.56 btu |

The numerical values presented in Table I. were derived from LTES application cycles in an embodiment employing isopentane as turbine medium in a system supplied by steam turbine exhaust as its external heat supply at a 340° F. temperature, in which condensate leaving the hydrocarbon condenser 6 was at 90° F., and in which that condensate return supplying injectors 53, 54 had acquired a temperature of 170° F. after being circulated through the ammonia condenser 2 and the rectifier stage 48 illustrated in FIG. 1.

The cycle conditions described were selected for illustrative purposes only, abstracted from a reference basic turbine cycle component within a LTES total system equipment complement.

The conventional ORC cycle presented in FIG. 2 illustrates a simple conventional ORC expansion from saturation to exhaust pressure, that yields a theoretical 50.13 btu output work per pound of iso-pentane heated by the external heat source. Comparing the alternatives diagrammed in FIG. 2 by their associated thermodynamic data tabulated in Table I., illustrates that same ORC turbine component with two injection points yielded 53.56 btu from the same external heat source energy input, an increase of 6.8% from the conventional above ambient ORC turbine component of the total LTES installation.

In an LTES application, the mass flow required in the above-ambient turbine cycle is dictated by the amount needed to absorb regenerative waste heat discharged, as described, from the AR sub-system. Since minimizing that mass flow increases the ratio of more efficiently delivered power contributed by the sub-ambient turbine 11, optimization for an LTES application suggests taking advantage of the fact that after acquiring that regenerative transfer, by injecting 0.167 lbs. in the mass flow within the cycle below turbine entry, more effective advantage might be obtained for the total LTES cycle using the injection turbine concept. In the reference LTES example, 91% of the external heat energy supplied to the system was used to supply the ORC turbine boiler 56, while the remainder supplied external heat to the entire sub-ambient (the AR sub-system). However, the above-ambient conventional cycle delivered only 87% of the total LTES output, while the remainder (delivered by the sub-ambient turbine 11) delivered 13%. Using the injection cycle concept described, increasing concurrent mass flows in the AR sub-system and the LHT turbine cycles proportionately, i.e.—multiplying them by 1.167 in the total LTES example from which data cited was abstracted, being concurrently circulated in the LTES equipment complement, suggests that the LHT circuit would now deliver 1.167 ×13% or 15.17% of what it previously delivered, and total LTES external heat energy consumption would increase by 1.167×9%=10.5%, a 44% efficiency increase for the added incremental output power delivered from the LHT turbine cycle. The incremental output yield developed in the injection modified upper turbine triggers an additional improvement to the output of the LHT turbine cycle accompanying it in the total LTES equipment complement.

All that efficiency increase becomes available before additional efforts are made to recover what residual superheat might be left in the above ambient turbine exhaust by using it to further heat the medium in the LHT turbine 11 before sending the isopentane to its condenser 6. That should further increase output work received from the LHT turbine by increasing entry enthalpy of the medium flowing through that turbine.

Finally, prior art has also taught that for selected temperature and pressure ranges of a hydrocarbon turbine cycle, blends of two or more hydrocarbon media may offer additional advantages compared with confining media selection to any given "pure" material. As a result, in some cases, as media mixtures expand, one of the mixture components may reach saturation conditions at its partial pressure (closer to its saturation temperature than another component), and may result in necessitating use of more than one condenser operating at different pressures to effect condensation of the mix. Should that happen, the colder of the condenser products may be a preferred material to employ as a regenerative heat recovery medium, prior to remixing to reconstitute the blend used to supply the hot end of the cycle. Under those conditions, the medium fraction selected for supplying the injectors would be of a different composition than the expanding vapor receiving injected material to reconstitute the intended blend proportions below the injection point. The thermodynamic properties thereafter would then possess the properties of the blend intended for the remaining portion of the cycle.

An embodiment of the invention could consist of the equipment complement heretofore described as comprising an embodiment of the LTES, modified by routing the conduit carrying the return feed stream from the ambient turbine condenser via the heat exchangers serving to remove waste heat from the associated refrigeration subsystem to supply a manifold in conduit 50 supplying one or more injectors 53, 54 mounted along the expansion path of the upper turbine 10 in the system to permit measured amounts of the preheated feed stream to be injected into the turbine cycle. The remainder left after extracting the portion fed to the injectors through branch conduits 51, 52 then continues to the hydrocarbon boiler 56. Everything else about the entire LTES system installation remains unaltered other than maintaining the same proportions of other mass flows of fluids in circulation to those in the injector-improved conventional ORC cycle, all per the total system diagram shown as FIG. 1.

Figure 3:
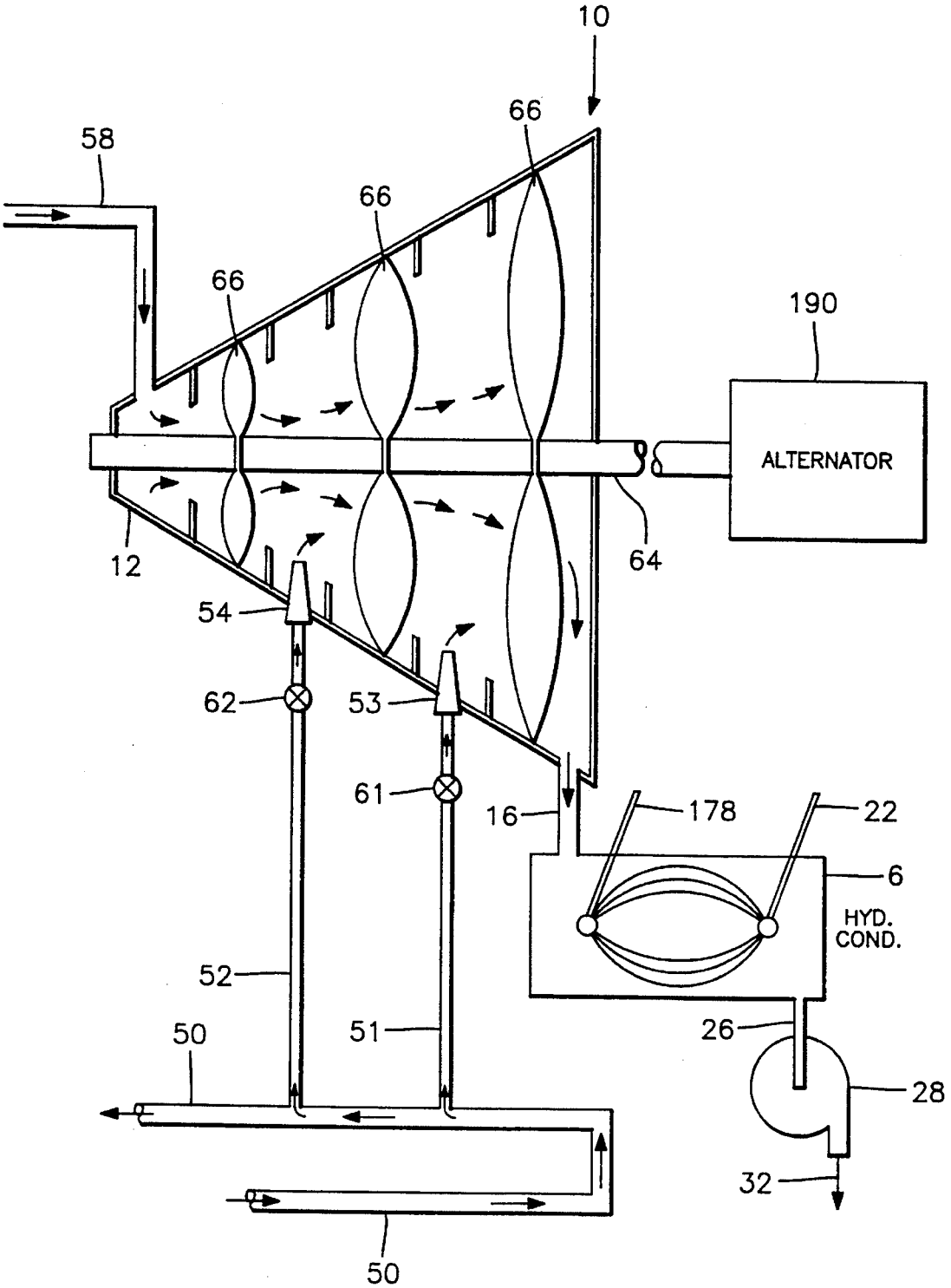
FIG. 3 is an enlarged schematic cross-sectional view of the injection turbine shown in FIG. 1.

FIG. 3 illustrates a large scale schematic diagram of the alteration required to install the improvement in the basic conventional ORC turbine component of the total LTES equipment complement. Turbine 10 has housing 12, shaft 64 and rotor blades 66 mounted on the shaft for driving it. Injectors 53, 54 extend through the housing at selected Positions, such as between stages.

I claim:

1. A power turbine system operating in an organic Rankine cycle with a thermodynamic medium flow therethrough comprising:

a power turbine having an inlet and an exhaust;

a first circulating thermodynamic turbine medium;

a low temperature engine system having a heat engine, and a second circulating thermodynamic turbine medium flowing through said heat engine and producing rejected waste heat during engine system operation;

means for regenerative heat transfer of said rejected waste heat by heat exchange relationship with said first turbine medium for preheating said first turbine medium to produce liquid phase medium at an elevated temperature not less than the temperature resulting from said preheating;

pump means having inlet means for receiving said liquid phase turbine medium at said elevated temperature, and outlet means;

injector means for injecting said liquid phase turbine medium from said pump outlet means into said turbine at at least one position therein for mixing with a flowing vapor stream of said first turbine medium flowing through said power turbine at a selected internal turbine pressure to produce a resulting mixture; and means for controlling the mass flow of said injected liquid phase turbine medium into said turbine for effecting a selected vapor quality of said resulting mixture; and said first turbine medium comprising a thermodynamic medium having a tendency to diverge toward the superheated region from the saturation curve thereof during isentropic expansion of the vapor thereof across the pressure gradient traversed by the turbine cycle.

2. The power turbine system as claimed in claim 1 wherein: said injector means is positioned in said turbine at a point beyond dry vapor entry condition of said first turbine medium so that said resulting mixture of injected fluid with partially expanded vapor in the turbine constitutes a mixture whose vapor quality is approximately that of saturated vapor for the temperature and pressures resulting from said mixture produced by said injection.

3. The power turbine system as claimed in claim 1 and further comprising:

means for condensing said first turbine medium exhausted from said turbine by external ambient cooling; and means for controlling said liquid phase turbine medium injected into said power turbine by said injector means so that the temperature of said liquid phase turbine medium during injection is higher than the temperature of said liquid phase turbine medium condensed by said external ambient cooling, said higher temperature being produced by said regenerative heat transfer from said low temperature engine system.

4. The power turbine system as claimed in claim 1 wherein:

said liquid phase turbine medium injected by said injector means has a different chemical composition than the chemical composition of said first turbine medium vapor flowing through said turbine into which said liquid phase turbine medium is injected and mixed, said liquid turbine medium injected being supplied from a selected and preheated fraction of said condensate produced by condensation of turbine exhaust vapor.

5. The power turbine system as claimed in claim 1 wherein:

said injector means comprises a plurality of injectors positioned in spaced relationship along said turbine cycle in said power turbine;

said pump means pumps said heated liquid phase turbine medium to said injectors at a pressure sufficient to inject a selected fraction thereof at a highest pressure injector position and a corresponding fraction of said injected liquid phase turbine medium to each lower pressure injector; and said control means comprises pressure reducing means for controlling measured amounts of said liquid phase turbine medium at a desired pressure for each injector.

6. The power turbine system as claimed in claim 1 and further comprising:

boiler means for heating said turbine medium from said liquid phase pump means to convert said liquid phase turbine medium to a vapor phase;

first inlet means in said boiler means;

conduit means between said pump means and said first boiler inlet means for conducting preheated liquid phase turbine medium to said first boiler inlet means as the boiler feed return stream;

first boiler outlet means;

conduit means for conducting said vapor phase turbine medium from said first boiler outlet means to said power turbine inlet;

an ambient heat source of heating fluid;

second boiler inlet means for receiving said heating fluid from said ambient heat source for heating said liquid phase turbine medium in said boiler means;

second boiler outlet means for returning said heating fluid from said boiler means to said ambient heat source; and branch conduit means for conducting liquid phase turbine medium from said boiler feed return stream conduit means to said injector means;

said pump means providing sufficient pressure for operation of said injector means.

7. The power turbine system as claimed in claim 6 wherein:

said power turbine comprises a multi-stage turbine;

an intermediate chamber is provided in said turbine between successive turbine stages for receiving turbine vapor flow from the respective preceding turbine stage; and said injector means comprises a plurality of injectors positioned in spaced relationship along said turbine cycle so that at least one injector injects said liquid phase turbine medium into a respective intermediate chamber and said resulting mixture in each of said intermediate chambers is delivered to the next succeeding turbine stage for continued expansion.

8. The power turbine system as claimed in claim 2 wherein:

said power turbine comprises a multi-stage turbine;

an intermediate chamber is provided in said turbine between successive turbine stages for receiving turbine vapor flow from the respective preceding turbine stage; and said injector means comprises a plurality of injectors positioned in spaced relationship along said turbine cycle so that at least one injector injects said liquid phase turbine medium into a respective intermediate chamber and said resulting mixture in each of said intermediate chambers is delivered to the next succeeding turbine stage for continued expansion.

9. The power turbine system as claimed in claim 3 wherein:

said power turbine comprises a multi-stage turbine;

an intermediate chamber is provided in said turbine between successive turbine stages for receiving turbine vapor flow from the respective preceding turbine stage; and said injector means comprises a plurality of injectors positioned in spaced relationship along said turbine cycle so that at least one injector injects said liquid phase turbine medium into a respective intermediate chamber and said resulting mixture in each of said intermediate chambers is delivered to the next succeeding turbine stage for continued expansion.

10. The power turbine system as claimed in claim 4 wherein:

said power turbine comprises a multi-stage turbine;

an intermediate chamber is provided in said turbine between successive turbine stages for receiving turbine vapor flow from the respective preceding turbine stage; and said injector means comprises a plurality of injectors positioned in spaced relationship along said turbine cycle so that at least one injector injects said liquid phase turbine medium into a respective intermediate chamber and said resulting mixture in each of said intermediate chambers is delivered to the next succeeding turbine stage for continued expansion.

11. The power turbine system as claimed in claim 6 wherein:

said power turbine comprises a multi-stage turbine;

an intermediate chamber is provided in said turbine between successive turbine stages for receiving turbine vapor flow from the respective preceding turbine stage; and said injector means comprises a plurality of injectors positioned in spaced relationship along said turbine cycle so that at least one injector injects said liquid phase turbine medium into a respective intermediate chamber and said resulting mixture in each of said intermediate chambers is delivered to the next succeeding turbine stage for continued expansion.

12. The power turbine system as claimed in claim 1 wherein:

said low temperature engine system comprises an absorption-refrigeration subsystem having a circulating absorbent-refrigerant liquid for receiving and for synthesizing and imparting to a subambient turbine condenser a continuous-flow low temperature heat sink at a selected temperature, said heat engine, heat energy input means, said second circulating thermodynamic medium in heat exchange relationship with said heat engine and said heat energy input means and in heat exchange relationship at said condenser with said absorption-refrigeration sub-system refrigerant, said second thermodynamic medium having a vaporization temperature lower than that of steam at the same pressure and a melting point temperature lower than that of water, said heat engine operating across a thermal gradient having a high temperature end receiving said second thermodynamic medium in heat exchange relationship with said heat energy input means and a low temperature end through which said second thermodynamic medium flows before heat exchange relationship thereof with said synthesized continuous-flow low temperature heat sink of the absorption-refrigeration subsystem, and an external cooling source for providing a cooling fluid in heat exchange relationship with said absorbent-refrigerant liquid external to a refrigerant liquid absorber.

13. The power turbine system as claimed in claim 11 wherein:

said low temperature engine system comprises an absorption-refrigeration subsystem having a circulating absorbent-refrigerant liquid for receiving and for synthesizing and imparting to a subambient turbine condenser a continuous-flow low temperature heat sink at a selected temperature said heat engine, heat energy input means, said second circulating thermodynamic medium in heat exchange relationship with said heat engine and said heat energy input means and in heat exchange relationship at said condenser with said absorption-refrigeration sub-system refrigerant, said second thermodynamic medium having a vaporization temperature lower than that of steam at the same pressure and a melting point temperature lower than that of water, said heat engine operating across a thermal gradient having a high temperature end receiving said second thermodynamic medium in heat exchange relationship with said heat energy input means and a low temperature end through which said second thermodynamic medium flows before heat exchange relationship thereof with said synthesized continuous-flow low temperature heat sink of the absorption-refrigeration subsystem, and an external cooling source for providing a cooling fluid in heat exchange relationship with said absorbent-refrigerant liquid external to a refrigerant liquid absorbent.

14. The power turbine system as claimed in claim 11 wherein:

said injector means comprises a plurality of injectors positioned in spaced relationship along said turbine cycle in said power turbine at a predetermined spaced relationship; and said means for controlling the mass flow of said injected liquid phase turbine medium comprises means for proportioning said liquid phase turbine medium injected through said injectors to provide a supply of superheat at a selected temperature at said turbine exhaust to a heat exchanger means disposed between said turbine exhaust and a condensor means for producing a controlled level of regenerative transfer heat energy to said turbine medium circulating in a subambient turbine in said low temperature energy system.

15. A method of operating a power turbine system in an organic Rankine cycle with a thermodynamic medium flowing therethrough comprising:

providing a power turbine having an inlet and an exhaust;

providing a first circulating thermodynamic turbine medium having a tendency to diverge toward the superheated region from the saturation curve thereof during isentropic expansion of the vapor across the pressure gradient traversed by the turbine cycle;

providing a low temperature engine system having a heat engine, a second circulating thermodynamic medium flowing through said heat engine and producing rejected waste heat during engine system operation;

passing said first turbine medium in heat exchange relationship with said rejected waste heat for regenerative heat transfer of said rejected waste heat for preheating said first turbine medium to produce liquid phase turbine medium at an elevated temperature not less than the temperature resulting from said preheating;

providing injector means in said power turbine;

pumping said liquid phase turbine medium at said elevated temperature through said injector means for injecting said liquid phase turbine medium into said turbine at at least one position therein for mixing with a flowing vapor stream of said first turbine medium flowing through said power turbine at a selected internal turbine pressure to produce a resulting mixture; and controlling the mass flow of said injected liquid phase turbine medium into said turbine for affecting a selected vapor quality of said resulting mixture.

16. The method as claimed in claim 15 and further comprising:

injecting said liquid phase turbine medium into said power turbine at a point beyond dry vapor entry condition of said first turbine medium so that said resulting mixture of said injected fluid with partially expanded vapor in the turbine constitutes a mixture whose vapor quality is approximately that of saturated vapor for the temperature and pressures resulting from said mixture produced by said injection.

17. The method as claimed in claim 16 and further comprising:

condensing said first turbine medium exhausted from said turbine by external ambient cooling; and controlling said liquid phase turbine medium injected into said power turbine so that the temperature thereof during injection is higher than the temperature of said liquid phase turbine medium condensed by said external ambient cooling, said higher temperature being produced by said regenerative heat transfer from said low temperature engine system.

18. The method as claimed in claim 15 wherein:

said injection step comprises injecting liquid phase turbine medium having a different chemical composition than the chemical composition of said first turbine medium vapor flowing through said turbine; and supplying said liquid phase turbine medium injected from a selected and preheated fraction of said condensate produced by condensation of turbine exhaust vapor.

19. The method as claimed in claim 15 wherein:

said injection step comprises injecting said liquid phase turbine medium through a plurality of injectors at positions in spaced relationship along said turbine cycle in said power turbine;

pumping said heated liquid phase turbine medium to said injectors at a pressure sufficient to inject a selected fraction thereof at a highest pressure and a corresponding fraction of said injected liquid phase turbine medium to each subsequent position at a lower pressure; and controlling said injection to inject measured amounts of said liquid phase turbine medium at a desired pressure for each injection position.

20. The method as claimed in claim 19 wherein:

said power turbine is a multi-stage turbine; and said liquid phase turbine medium is injected into said turbine between said stages.

* * * * *